US008049707B2

(12) United States Patent
Wood

(10) Patent No.: US 8,049,707 B2
(45) Date of Patent: Nov. 1, 2011

(54) DISPLAY APPARATUS AND METHOD WITH REDUCED ENERGY CONSUMPTION

(76) Inventor: Lawson A. Wood, Arlington, VA (US)

( * ) Notice: Subject to any disclaimer, the term of this patent is extended or adjusted under 35 U.S.C. 154(b) by 1100 days.

(21) Appl. No.: 11/237,707

(22) Filed: Sep. 29, 2005

(65) Prior Publication Data

US 2006/0250323 A1 Nov. 9, 2006

Related U.S. Application Data

(60) Provisional application No. 60/678,788, filed on May 9, 2005.

(51) Int. Cl.
*G09G 3/36* (2006.01)

(52) U.S. Cl. ..... 345/102; 345/84

(58) Field of Classification Search ..... 345/84–111, 345/204–215, 690–699
See application file for complete search history.

(56) References Cited

U.S. PATENT DOCUMENTS 6,921,172 B2 7/2005 Ulichney et al.
6,947,018 B1 * 9/2005 Yamazaki ..... 345/75.2
7,218,437 B2 5/2007 Selbrede
2002/0050974 A1 * 5/2002 Rai et al. ..... 345/102
2002/0130830 A1 * 9/2002 Park ..... 345/99
2003/0189558 A1 * 10/2003 Aoki et al. ..... 345/204
2004/0207589 A1 * 10/2004 Kim et al. ..... 345/89
2005/0184952 A1 * 8/2005 Konno et al. ..... 345/102
2005/0185149 A1 8/2005 Lurkens et al.
2005/0231457 A1 * 10/2005 Yamamoto et al. ..... 345/102
2005/0271291 A1 12/2005 Liang
2006/0029252 A1 2/2006 So
2006/0103612 A1 * 5/2006 Ozaki ..... 345/83
2006/0125770 A1 * 6/2006 Kao et al. ..... 345/102

FOREIGN PATENT DOCUMENTS

JP 2005-020274 * 1/2005
WO WO 2004/090997 * 10/2004

* cited by examiner

*Primary Examiner* — Chanh Nguyen
*Assistant Examiner* — Long Pham

(57) ABSTRACT

A display apparatus includes a spatial light modulator and an illumination unit for supplying light to the spatial light modulator. The power consumed by the illumination unit is reduced by adjusting both the intensity of light emitted by the illumination unit and video words that are supplied to the spatial light modulator in accordance with what is to be displayed.

19 Claims, 3 Drawing Sheets

DISPLAY APPARATUS AND METHOD WITH REDUCED ENERGY CONSUMPTION

CROSS-REFERENCE TO RELATED APPLICATION

This application claims the benefit of priority under 35 USC 119 of U.S. provisional application No. 60/678,788, filed on May 9, 2005.

BACKGROUND OF THE INVENTION

The present invention is directed to techniques for providing a display apparatus having reduced energy consumption. Such reduced-energy display apparatuses would be particularly useful in battery-powered applications, such as display apparatuses in laptop computers, digital cameras, PDAs, or cell phones.

Some display apparatuses generate their own light. Examples include cathode ray tube monitors, plasma display panels, and field emission displays. Other display apparatuses employ spatial light modulators (SLMs) to modulate light emitted by an illumination unit. Known types of SLMs include LCD panels, liquid-crystal-on-silicon chips, and digital micromirror devices. The illumination units that are currently (2005) used with LCD panels typically emit white light at a constant intensity, and each display element (that is, liquid crystal cell) of the panel is provided with its own color filter. However, it is also known to use an illumination unit that bathes the back of an LCD-panel with flashes of red, green, and blue light. This triples the resolution of the display apparatus, because a single display element can be used to modulate all three primary colors (instead of three filtered display elements being needed in order to produce the entire spectrum), but the LCD panel must be capable of operation at a higher-speed. Display apparatuses of this type are frequently called field sequential displays.

Display apparatuses that employ digital micromirror devices may use an illumination unit that includes a color wheel in order to expose a single DMD to light of three different colors, or the illumination unit may include different light sources for each color. Display apparatuses are also known that use three DMDs or three LCOS chips, with each DMD or LCOS chip being exposed to one of the three primary colors and with the images produced by the three DMDs or LCOS chips being combined so as to yield a single colored image.

In all of these display apparatuses, the illumination unit emits light in some predetermined manner, regardless of how this light is modulated by the SLM. For example, many LCD display apparatuses that are currently used in digital cameras or laptop computers employed backlighting units that are driven at a constant intensity from frame to frame, even if the scene that is shown on the display apparatus is a dark one. In effect, more light is generated than is needed, and the LCD panel then attenuates the unnecessary light

SUMMARY OF THE INVENTION

The object of the present invention is to reduce the amount of power required by a display apparatus of the type that employs an illumination unit and a spatial light modulator. This object can be attained by adjusting video words that specify what is shown on the spatial light modulator so as to permit a temporary reduction in the amount of light produced by the illumination unit.

In accordance with one aspect of the invention, a set of video words is examined to determine whether substantially all of them have values less than a predetermined value. If so, the values of at least some of the video words in the set (those with values greater than zero, for example) are increased to form a set of converted video words. The converted video words are supplied to the spatial light modular for display. The light emitted by the illumination unit is adjusted so as to compensate for the increase in the values of the video words during the formation of the set of converted video words.

The examination of the video words may involve finding the maximum value of the video words in the set. Alternatively, the examination may involve comparing the video words in the set to a set of threshold values.

DESCRIPTION OF THE PREFERRED EMBODIMENTS

Figure 1A:
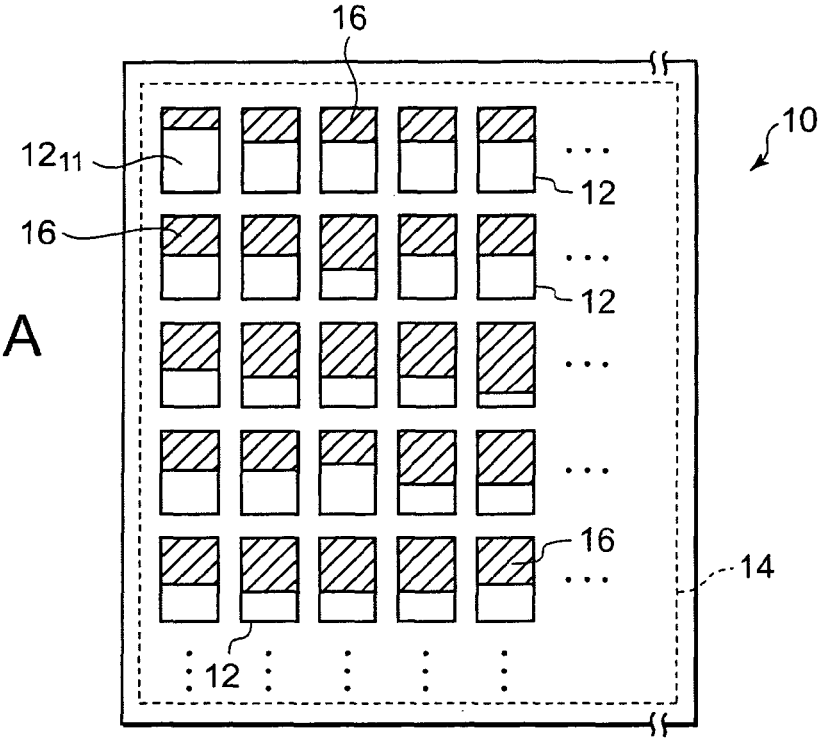
FIG. 1A schematically illustrates a back-lighted advertising billboard having an array of windows and adjustable shades in front of the windows and is presented in conjunction with FIG. 1B to help explain the conceptual basis of the present invention.

The conceptual basis of the present invention will first be explained, and then practical embodiments will be described.

The Conceptual Basis

The basic idea behind the present invention will now be explained with the aid of FIGS. 1A and 1B In FIG. 1A, an advertising billboard 10 has an array of windows in it. A backlighting unit 14 bathes the back side of the billboard 10 with white light. An adjustable shade 16 is provided for each of the windows. The shades 16 are opaque, and attenuate the amount of light streaming through each window 16 by an amount corresponding to the portions of the windows 16 that they cover. A workman can change a black-gray-white image shown on the billboard 10 by manually adjusting the shades 16 to display a new black-gray-white image.

Suppose that the image that is shown on billboard 10 is a dark one, and that the shade 16 of the window at the first row and first column of the array (marked $\mathbf{12}_{11}$ in the drawings) is adjusted so as to permit the window $\mathbf{12}_{11}$ to pass only 80% of the light falling on the back side of the window $\mathbf{12}_{11}$. Also suppose that no more light is transmitted through any of the other windows 12 of the billboard 10 (that is, all other windows 12 transmit 80% of the light or less). Then the shade 16 of the window $\mathbf{12}_{11}$ can be raised, as shown in FIG. 1B, to permit the window $\mathbf{12}_{11}$ to pass 100% of the light. This is accompanied by a downward adjustment in the brightness of the light emitted by the backlighting unit 14, so that the same amount of light streams through the window $\mathbf{12}_{11}$ in FIG. 1B as streams through in FIG. 1A, and by an upward adjustment of the shades 16 for the other windows 12.

Figure 1B:
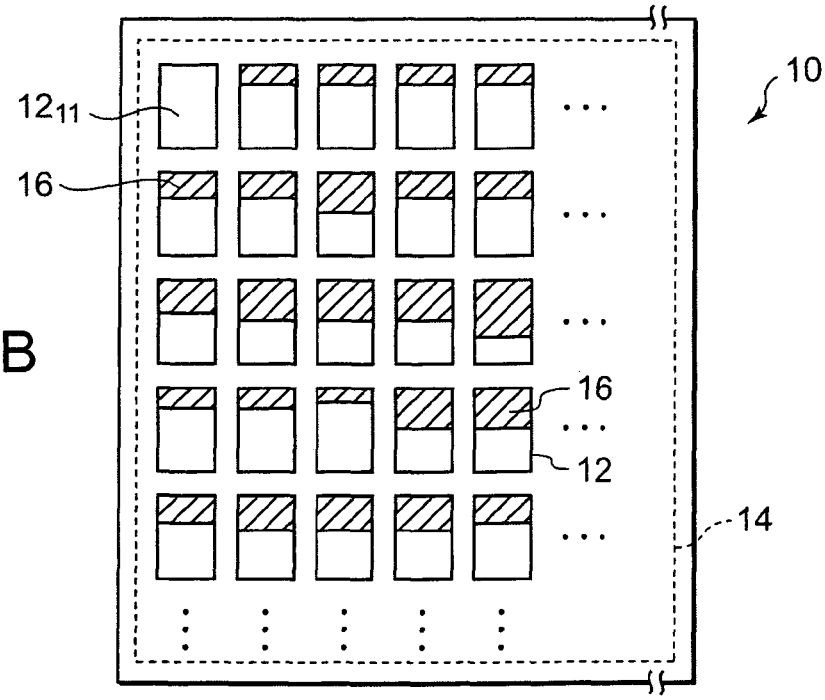
FIG. 1B schematically illustrates the advertising billboard that is shown in FIG. 1A, with the shades being adjusted to increase the transmission of light through the windows and with the intensity of the backlighting being reduced.

In particular, if a maximally bright display element in FIG. 1A (that is, window $\mathbf{12}_{11}$) transmits 80% of light, the same effect can be obtained (in FIG. 1B) by multiplying this 80% transmission factor by its receptacle (that is, 1/0.8, or 1.25), by multiplying the transmission factors for the other windows 12 by the same amount (that is, by 1.25), and by reducing the intensity of the light emitted by backlighting unit 14 so that its new intensity is 80% of its former value.

The First Embodiment

Figure 2A:
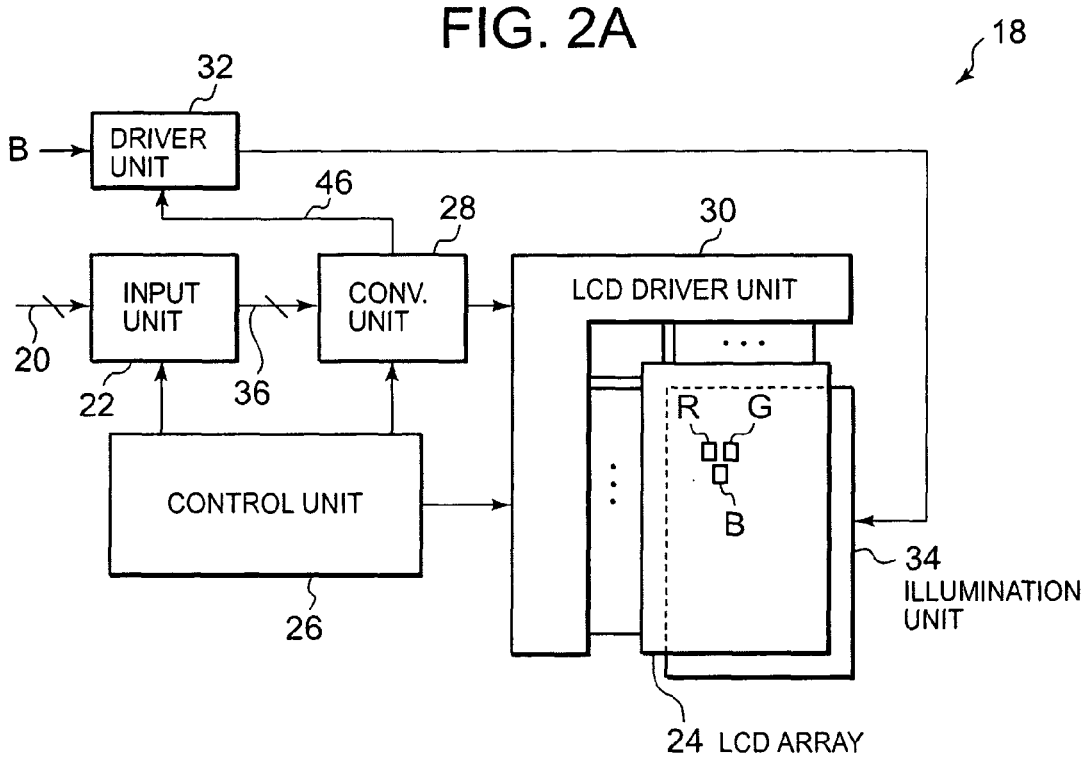
FIG. 2A illustrates a first embodiment of the present invention, in which a display apparatus employs an illumination unit that emits white light and an LCD panel with a colored filter for each liquid crystal cell.

FIG. 2A illustrates a display unit 18 in accordance with a first embodiment of the present invention. A bus 20 supplies digital signals for the red, green, and blue components of a frame to an input unit 22. The signals for the red, green, and blue components consist of multi-bit video data words (also but not exclusively referred to throughout as "video words"), each specifying one of a plurality of binary levels for the red, green, or blue brightness of spots that are to be displayed by an LCD array 24. The LCD array 24 has display elements (individual liquid crystal cells) that received light colored by a red R, green G, or blue B filter (only three of which are shown in FIG. 2A). The video words for the red, green, and blue components are coordinated with the display elements in such a manner that each of the video words for the red component designates a transmission factor for a corresponding one of the display elements with red filters, each of the video words for the green component designates a transmission factor for corresponding one of the display elements with green filters, and the same for the video words for the blue component. For the sake of convenience, the video words for the red, green, and blue components of a frame will hereafter be called red video words, green video words, and blue video words.

The input unit 22 stores the video words received via bus 20 in accordance with control signals received from a control unit 26. A conversion unit 28 receives the stored video words, locates one or more video words in the frame having the largest value, and calculates a conversion factor for multiplying all of the video words. These converted video words are then supplied to an LCD driver unit 30, which addresses the display elements in the array 24 in a row by row manner and supplies the converted video words to the display elements to which they correspond.

A simple example will help illustrate this. Suppose that each of the video words has five bits, so the video words can have values ranging from 00000 (zero in decimal) to 11111 (31 in decimal). This provides 32 intensity levels. Suppose also that one or more of the video words for a given frame has a value of 11000 (24 in decimal), and that none of the video words for the frame has a higher value. Then the video words with the largest values specify a transmissivity for the corresponding display elements that is 24/32 (or ¾) of 100% transmission. The video words with the largest values can be multiplied by the reciprocal of ¾ (that is, 4/3) to bring the transmissivity of the display elements corresponding to the video words with the largest values up to 100%, and the remaining video words can be multiplied by the same conversion factor (4/3) to raise them proportionately.

A driver unit 32 for illumination unit 34 receives a brightness signal B, which establishes a desired or nominal level for the brightness of the images that are to be displayed. The signal B may be a preset value, or may be a value that is adjustable by the user of the display apparatus 18, or it may be a value that is both user-adjustable and dependent on the intensity of the ambient light. The conversion unit 28 supplies a signal to the driver unit 32 for modifying the magnitude of the signal B in accordance with the maximum value of the video words for the frame. In the example above, where the maximum value was 11000 (or ¾ of the potential maximum, 11111 plus the zero level), the signal B would be multiplied by ¾ to provide a converted signal for driving the illumination unit 34 at a reduced level.

Figure 2B:
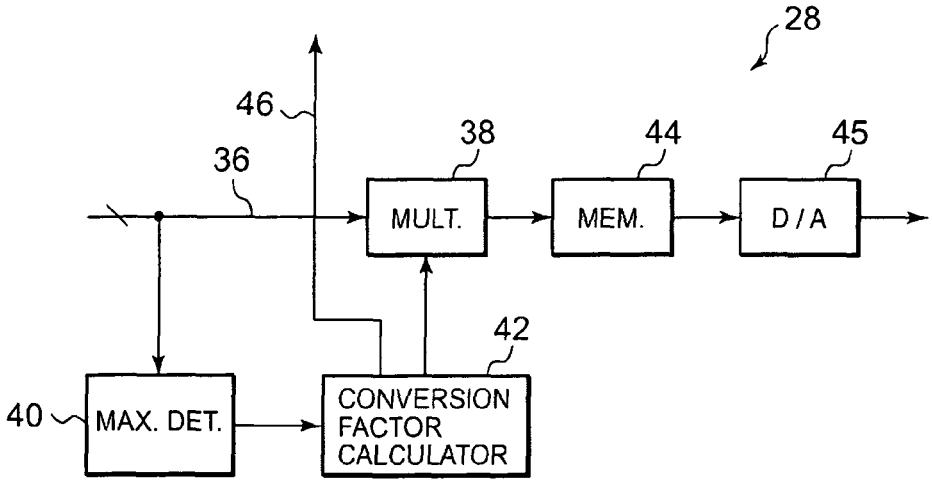
FIG. 2B illustrates a conversion unit used in the display apparatus of FIG. 2A.

FIG. 2B shows the construction of the conversion unit 28. A bus 36 carries the raw video words from the input unit 22 to a multiplier 38 and to a maximum value detector 40. The maximum value detector 40, as its name suggests, detects the maximum value of the video words for a frame. The maximum detected value is supplied to a conversion factor calculator 42, which calculates a conversion factor for multiplying all of the raw video words and supplies this conversion factor to the multiplier 38. After multiplication, the converted video words are stored in a memory 44. Thereafter, the converted video words are read out by the control unit 26, transformed to analog signals by a D/A converter 45, and fed to the LCD driver unit 30.

The calculator 42 also calculates an intensity modification signal that is supplied by a line 46 to the driver unit 32.

The Second Embodiment

Figure 3:
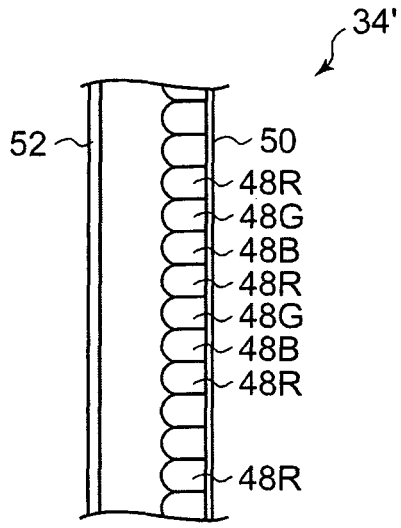
FIG. 3 is a cross-sectional view of a portion of an illumination unit used in a second embodiment.

The second embodiment differs from the first embodiment in that the second embodiment is directed to a field sequential liquid crystal display apparatus. The LCD array 24 in the second embodiment lacks the red, green, and blue filters that are shown in FIG. 2A. Furthermore, the illumination unit 34 in the second embodiment includes red, green, and blue light sources. The light sources may be a set of red LEDs, a set of green LEDs, and a set of blue LEDs. For example, FIG. 3 is a side view of a portion of an illumination unit 34' used in this embodiment. It includes LEDs 48R, 48G, and 48B mounted on a support 50 and disposed behind an optical diffusion plate 52.

During operation, the input unit 22 in the second embodiment transmits the red video words for an entire frame to the conversion unit 28, which then detects one or more red video words having the largest value. Based on this largest detected value, the conversion unit 28 calculates a conversion factor for multiplying all of the red video words before they are converted to analog and supplied to the LCD driver unit 30. The conversion unit 28 also calculates a conversion factor for multiplying a brightness signal $B_R$ (a brightness signal for the red component). The converted brightness signal is supplied to the illumination unit 34, and the illumination unit 34 emits an amount of red light designated by the converted brightness signal to the back of the LCD array 24. The green and blue components of the frame are displayed in the same way.

A significant advantage of the second embodiment, over the first embodiment, is that the maximum-value video words for each color component are detected individually. It may happen that an image to be displayed is primarily red and green and has very little blue in it. If the maximal blue video word (or words) for the frame has a relatively small value, the amount of blue light emitted by the illumination unit 34 can be reduced considerably. In contrast, in the first embodiment, the red, green, and blue video words were all considered together when the maximum value was detected.

The Third Embodiment

The third embodiment is similar to the second embodiment in that it is directed to a field-sequential display. The difference is that the video words are not examined to determine their maximum value in the third embodiment; instead, they are compared to a set of predetermined threshold values. Using again video words with five bits as an example, the 32 possible intensity values afforded by five bits might be divided into eight ranges by comparing the video words to 7/8×32=28 (11100 in binary), 6/8×32=24 (11000 in binary), 5/8×32=20 (10100 in binary), 4/8×32=16 (10000 in binary), and so on. Using the binary numbers 11100, 11000, 10100, 11100, and so on as threshold values, it is first determined whether any of the video words for the relevant color component of a frame (red, for example) lies in the highest intensity range (that is, whether any of the video words for the color component has a value higher than 7/8, or 11100 in binary). If so, the raw video words are multiplied by one and the "converted" video words that are fed to the LCD driver unit 30 are the same as the raw video words. If none of the video words for the color component of the frame lies in the highest intensity range, it is then determined if any lie in the second highest (that is, if 7/8 or 11100 in binary is the minimum threshold level that is not exceed by any of the video words for the relevant color component). If so, the raw video words are multiplied by 8/7 to form the converted video words and the brightness signal supplied to the driver unit 32 is multiplied by 7/8. If none of the video words for the color component of the frame lies in the top two intensity ranges, it is then determined if any lie in the third-highest intensity range (that is, if 6/8 or 11000 in binary is not exceeded by any of the video words for the relevant color component). If so, the raw video words are multiplied by 4/3 to form the converted video words, and the brightness signal is multiplied by ¾. The lower intensity ranges are examined in the same way if none of the video words for the relevant color component of the frame lies in the three highest intensity ranges.

In short, instead of examining all of the video words for each color component of a frame in order to detect the maximum value of the video words for each color component (as in the second embodiment), in the third embodiment it is only necessary to detect the minimum threshold level that is not exceeded by at least one video word for each color component of a frame.

Figure 4:
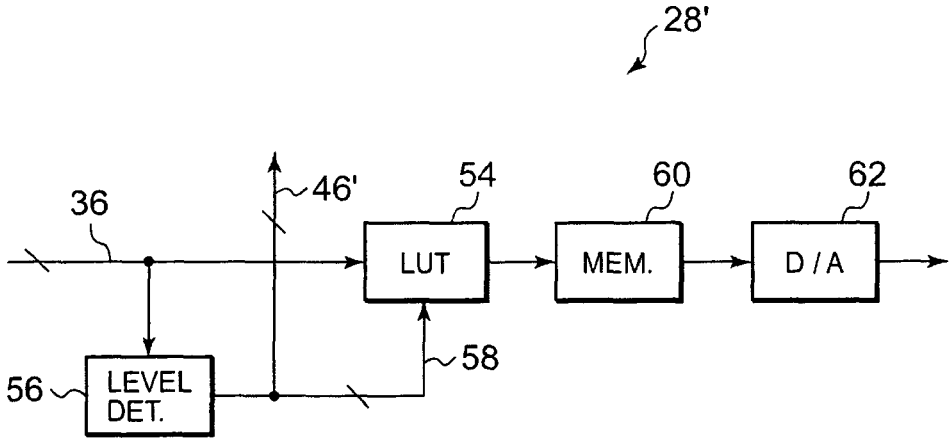
FIG. 4 is a schematic diagram of a conversion unit used in a third embodiment.

FIG. 4 illustrates a conversion unit 28' for use in the third embodiment. The bus 36 carries the raw video words for a given color component of a frame (red, for example) to a look-up table memory 54 and to a level detector 56. The level detector 56 compares each video word for the color component to threshold values that divide the possible values for the video words into a hierarchy of ranges. This reduces the performance that is required of the conversion unit. It should be noted that this scheme would permit a table look-up memory with only eight address bits to be used to generate converted video words from five-bit video words that are compared to eight threshold values, instead of a hardware multiplier or multiplication routine. Zero may be used as one of the threshold values because if none of the video words of a given color component of a frame has a magnitude greater than zero, then all of these video words have a value of zero and it is not necessary to actuate the LEDs 48 for that color component at all.

A digital signal identifying the largest threshold value that has not been exceeded by any of the video words for the relative color component is conveyed by a bus 58 to the look up table 54 and by a bus 46' to the driver unit 32. The signals on busses 36 and 58 serve as address signals for the look up table 54, which stores the products of the possible values of the video words times conversion factors that are determined by the highest threshold value not exceeded. Converted video words from the look up table 54 are stored in a memory 60. When they are read out of the memory 60 by the control unit 26, they are converted to analog signals by a D/A converter 62 and supplied to the LCD driver unit 30.

It will be understood that the above description of the present invention is susceptible to various modifications, changes, and adaptations, and the same are intended to be comprehended within the meaning and range of equivalents of the appended claims.

What is claimed is:

1. A method for driving a display apparatus having a spatial light modulator and an illumination unit that includes at least one red LED, at least one green LED, and at least one blue LED, comprising the steps of:

(a) examining a set of red video words to determine whether substantially all of the red video words in the set of red video words have values less than a predetermined value for red;

(b) if substantially all of the red video words in the set of red video words have values less than the predetermined value for red, increasing the values of at least some of the red video words in the set of red video words to form a set of converted red video words;

(c) supplying the set of converted red video words to the spatial light modulator;

(d) adjusting the light emitted by the at least one red LED to compensate for the increasing of the values in step (b);

(e) examining a set of green video words to determine whether substantially all of the green video words in the set of green video words have values less than a predetermined value for green;

(f) if substantially all of the green video words in the set of green video words have values less than the predetermined value for green, increasing the values of at least some of the green video words in the set of green video words to form a set of converted green video words;

(g) supplying the set of converted green video words to the spatial light modulator;

(h) adjusting the light emitted by the at least one green LED to compensate for the increasing of the values in step (f);

(i) examining a set of blue video words to determine whether substantially all of the blue video words in the set of blue video words have values less than a predetermined value for blue;

(j) if substantially all of the blue video words in the set of blue video words have values less than the predetermined value for blue, increasing the values of at least some of the blue video words in the set of blue video words to form a set of converted blue video words;

(k) supplying the set of converted blue video words to the spatial light modulator; and (l) adjusting the light emitted by the at least one blue LED to compensate for the increasing of the values in step (j), wherein step (a) comprises comparing the set of red video words to a set of threshold values, the predetermined value for red being a threshold value that is included in the set, and wherein there are a predetermined number of possible values for the red video words and a predetermined number of threshold values in the set, the number of threshold values in the set being substantially smaller than the number of possible values for the red video words.

2. The method of claim 1, wherein step (b) comprises multiplying the red video words in the set of red video words by a conversion factor to generate the set of converted red video words, the conversion factor being greater than one.

3. The method of claim 2, wherein step (d) comprises reducing the light emitted by the at least one red LED by multiplying a nominal light intensity value by the reciprocal of the conversion factor.

4. The method of claim 1, wherein step (c) comprises selecting values from a set that contains possible values for the red video words multiplied by conversion factors that are based on the threshold values.

5. A method for driving a display apparatus having a spatial light modulator and an illumination unit, comprising the steps of:

(a) comparing a set of threshold values to a set of video words, the video words having a predetermined number of possible values and the set of threshold values containing a predetermined number of threshold values, the number of threshold values in the set of threshold values being substantially smaller than the number of possible values for the video words;

(b) providing a set of converted video words based on the comparison;

(c) supplying the converted video words to the spatial light modulator; and (d) adjusting the light emitted by the illumination unit based on the comparison, wherein the spatial light modulator modulates light that is generated by the illumination unit, wherein the threshold values include a largest threshold value, and wherein the converted video words are the product of the video words multiplied by a conversion factor that is greater than one if all of the video words in the set of video words have values smaller than the largest threshold value.

6. The method of claim 5, wherein the digital words have a highest possible value, and wherein the conversion factor is substantially equal to the highest possible value divided by the lowest threshold value that is not exceeded by any of the video words of the set.

7. The method of claim 6, wherein step (d) comprises reducing the light by multiplying a nominal light intensity value by the reciprocal of the conversion factor.

8. The method of claim 5, wherein the set of video words is a set of video words for a predetermined color component.

9. The method of claim 5, wherein step (b) comprises addressing a table look up memory with the video words of the set and a digital value identifying the lowest threshold value in the set of threshold values that is not exceeded by any of the video words in the set of video words.

10. The method of claim 5, wherein step (c) comprises selecting the converted video words from a set that contains possible values for the video words multiplied by conversion factors that are based on the threshold values.

11. The method of claim 10, wherein the selecting step comprises reading the converted video words out of a look-up memory.

12. A method for driving a display apparatus having a spatial light modulator and an illumination unit that includes at least one red LED, at least one green LED, and at least one blue LED, comprising the steps of:

(a) comparing a set of threshold values to a set of red video words;

(b) generating a set of converted red video words based on the comparison in step (a);

(c) supplying the converted red video words to the spatial light modulator;

(d) adjusting the light emitted by the at least one red LED based on the comparison in step (a);

(e) comparing the set of threshold values to a set of green video words;

(f) generating a set of converted green video words based on the comparison in step (e);

(g) supplying the converted green video words to the spatial light modulator;

(h) adjusting the light emitted by the at least one green LED based on the comparison in step (e);

(i) comparing the set of threshold values to a set of blue video words;

(j) generating a set of converted blue video words based on the comparison in step (i);

(k) supplying the converted blue video words to the spatial light modulator; and (l) adjusting the light emitted by the at least one blue LED based on the comparison in step (i), wherein the red video words have a predetermined number of possible values and the set of threshold values contains a predetermined number of threshold values, the number of threshold values being substantially smaller than the number of possible values for the red video words, wherein the red video words have a highest possible value, and wherein the conversion factor is substantially equal to the highest possible value divided by the lowest threshold value that is not exceeded by any of the red video words of the set or red video words.

13. The method of claim 12, wherein step (b) comprises multiplying the red video words by a conversion factor that is greater than one.

14. The method of claim 12, wherein step (d) comprises reducing the light emitted by the at least one red LED by multiplying a nominal light intensity value by the reciprocal of the conversion factor.

15. A method for driving a display apparatus having a spatial light modulator and an illumination unit that includes at least one first LED that emits light having a first color, comprising the steps of:

(a) comparing a set of first video words having n bits with a set of threshold values that divide $2^n$ possible intensity values for the first video words into m intensity value ranges, where m and n are integers and m is substantially smaller than $2^n$; the m intensity value ranges including a maximum intensity value range;

(b) identifying a highest one of the intensity value ranges that includes an intensity value for at least one of the first video words in the set;

(c) converting substantially all of the first video words into a set of converted first video words based on the highest one of the intensity value ranges identified in step (b), step (c) being conducted so as to increase the intensity values of the first video words unless the maximum intensity value range is identified in step (b);

(d) supplying the converted first video words to the spatial light modulator; and (e) adjusting the light emitted by the at least one first LED based on the highest one of the intensity value ranges identified in step (b) to compensate for increasing the intensity values in step (c).

16. The method of claim 15, wherein step (c) comprises selecting the set of converted video words from a set the contains possible intensity values for the first video words multiplied by conversion factors corresponding to the intensity value ranges.

17. The method of claim 16, wherein the step of selecting the set of converted video words comprises reading the selected set of converted video words out of a look-up memory.

18. The method of claim 15, wherein the first color is red and the first video words define a red component of an image, wherein the illumination unit additionally includes at least one LED that emits green light and at least one LED that emits blue light, and wherein the method further comprises repeating steps (a)-(e) for video words that define a green component of the image and for video words that define a blue component of the image.

19. The method of claim 15, wherein m is not greater than half of $2^4$.

* * * * *